US005663521A

United States Patent [19]

Mandereau et al.

[11] Patent Number: 5,663,521

[45] Date of Patent: Sep. 2, 1997

[54] METHOD AND APPARATUS FOR CONTROLLING AN EQUILIBRATING SYSTEM SUBJECT TO VARYING TEMPERATURES AND LAYING ANGLES

[75] Inventors: Fabienne Mandereau; Arnault Beauvais, both of Bourges, France

[73] Assignee: Giat Industries, Versailles, France

[21] Appl. No.: 520,092

[22] Filed: Aug. 28, 1995

[30] Foreign Application Priority Data

Sep. 19, 1994 [FR] France ..... 94 11121

[51] Int. Cl.[6] ..... F41A 27/30; F41A 27/26

[52] U.S. Cl. ..... 89/37.08; 89/43.01; 89/43.02

[58] Field of Search ..... 89/37.07, 37.08, 89/37.09, 43.01, 43.02

[56] References Cited

U.S. PATENT DOCUMENTS

| | | | |
|---|---|---|---|
| 1,460,419 | 7/1923 | Joyce | 89/37.08 |
| 1,858,829 | 5/1932 | Joyce | 89/37.08 |
| 2,392,387 | 1/1946 | Joy | 267/121 |
| 2,946,263 | 7/1960 | Bruehl | 89/37.08 |
| 2,960,010 | 11/1960 | Aldrin | 898/37.08 |
| 3,033,085 | 5/1962 | Witkin | 89/37.08 |
| 5,196,642 | 3/1993 | Tripp | 89/37.08 |

FOREIGN PATENT DOCUMENTS

| | | | |
|---|---|---|---|
| 0 309 646 | 4/1989 | European Pat. Off. . | |
| 52-38800 | 3/1977 | Japan | 89/37.08 |
| WO 86/06157 | 10/1986 | WIPO | 89/37.08 |

OTHER PUBLICATIONS

Annex 2, MIL–HDBK–785(AR); Equilibrator Geometr for Adjustment, pp. 5–47, Mar. 30, 1990.

*Primary Examiner*—Michael J. Carone
*Assistant Examiner*—Matthew J. Lattig
*Attorney, Agent, or Firm*—Oliff & Berridge

[57] ABSTRACT

An equilibrating system connects a top carriage of a piece of artillery and a pivoting mass. The equilibrating system includes a pressurized gas chamber that exerts a force opposing a force exerted by the pivoting mass. The system also includes two mechanical control devices to modify the volume of gas in the chamber to compensate for adjustments in temperature and to modify the speed of adjustment of the volume of gas to compensate for different elevation laying angles.

16 Claims, 8 Drawing Sheets

P
E
FORCE (kg/cm²)
SIGHT ANGLE (DEGREES)

METHOD AND APPARATUS FOR CONTROLLING AN EQUILIBRATING SYSTEM SUBJECT TO VARYING TEMPERATURES AND LAYING ANGLES

BACKGROUND OF THE INVENTION

The present invention relates to a control mechanism according to the external temperate of the equilibrating system of a piece of artillery.

This system connects the top carriage of the piece of artillery and the mass (which notably comprises the ordnance of the artillery) pivotally mounted on this top carriage. This system comprises a gas chamber wherein the gas pressure exerts a force opposed to the force exceed by the pivoting mass above.

In the mechanism described in the document "US MIL SPECS" Military Handbook, the equilibration is carried out using a nitrogen chamber. The calculations are made by studying the moment generated by the equilibrator (i.e. the study of the adjustment of the force and the length of the lever arm). The readjustment of the equilibrating curve on the laying curve, according to the external temperature, is carried out using a pump that modifies the initial pressure and by varying the length of the lever arm to change the equilibrating moment for all the laying angles.

In the mechanism described in document EP-A-309646 A, the equilibrating pressure is determined according to the external temperature thanks to a control valve, a gas tank and a pressure sensor.

The disadvantages of the state of the technique described above lie in the fact that the equilibration is carried out by acting on the moments of unbalance and not on the laying load itself. The system requires the use of a pump to control the pressure as well as a pressure sensor.

SUMMARY OF THE INVENTION

One aim of the present invention is a produce a control mechanism which only uses mechanical control structure to ensure the most accurate equilibration possible according to varying external temperature. The equilibration acts on the laying load and not on the moment, and control is possible regardless of the elevation laying angle of the piece of artillery.

The subject of the invention is thus a control mechanism according to the external temperature of the equilibrating system of a piece of artillery. This system connects a top carriage of the piece of artillery and a mass mounted pivoting on the top carriage, and includes a pressurizable gas chamber that can exert an opposing force to the force exerted by the mass.

According to the invention, the control mechanism is characterized in that the gas chamber works in conjunction with a piston mobile with respect to the chamber during the angular displacement of the pivoting mass with respect to the top carriage, such that the gas pressure in the chamber varies according to the angular displacement above, and in that the volume of gas contained in the chamber is calculated so that at a given temperature, the gas pressure exerts a force opposing and roughly equal to the force exerted by the pivoting mass, and in that the equilibrating system comprises in addition a first mechanical device to modify the gas pressure for varying temperatures and a second mechanical device to modify the speed of adjustment in the volume of the gas during the angular displacement of the pivoting mass.

Thus, thanks merely to the two mechanical control devices allowing the volume of gas and the speed of adjustment in the volume of gas to be modified, the above forces may be balanced for a large range of temperatures and for any elevation laying angle of the piece of artillery.

According to an advantageous version of the invention, the piston may be connected to the top carriage by a rod hinged to the top carriage, the piston being slidingly mounted in a cylinder forming the gas chamber, the cylinder being connected in a hinged manner to the pivoting mass.

This piston slides in the cylinder during the modifications to the elevation laying angle of the piece of artillery which enables the gas pressure of the chamber to be modified and thus the forces to be balanced, at a given temperature, for any elevation laying angle.

Preferably, the first mechanical devices to modify the gas pressure of the chamber may comprise a second piston slidingly mounted in the cylinder opposite the first piston, the second piston being connected to structure enabling the piston to move with respect to the first piston during the angular displacement of the second pivoting mass to modify the volume of the gas.

The movement of the second piston enables the volume of gas of the chamber to be modified so as to take into account the adjustments in temperature.

Preferably also, the second mechanical devices may comprise structure enabling the speed of movement of the second piston during the angular displacement of the pivoting mass to be modified in order to modify the speed of adjustment in the volume of the gas.

The modification of the speed of adjustment in the volume of the gas of the chamber enables the forces to be balanced for any temperature and at any elevation laying angle.

Structure to control the movement may be formed, for example, of a cable and adjusting slides respectively enabling the initial volume of the gas chamber and the speed of adjustment of this volume to be controlled.

Other particularities and advantages of the invention will become apparent from the following description.

BRIEF DESCRIPTION OF THE DRAWINGS

In the appended drawings, given by way of non-exhaustive illustration.

DETAILED DESCRIPTION OF PREFERRED EMBODIMENTS

Figure 1:
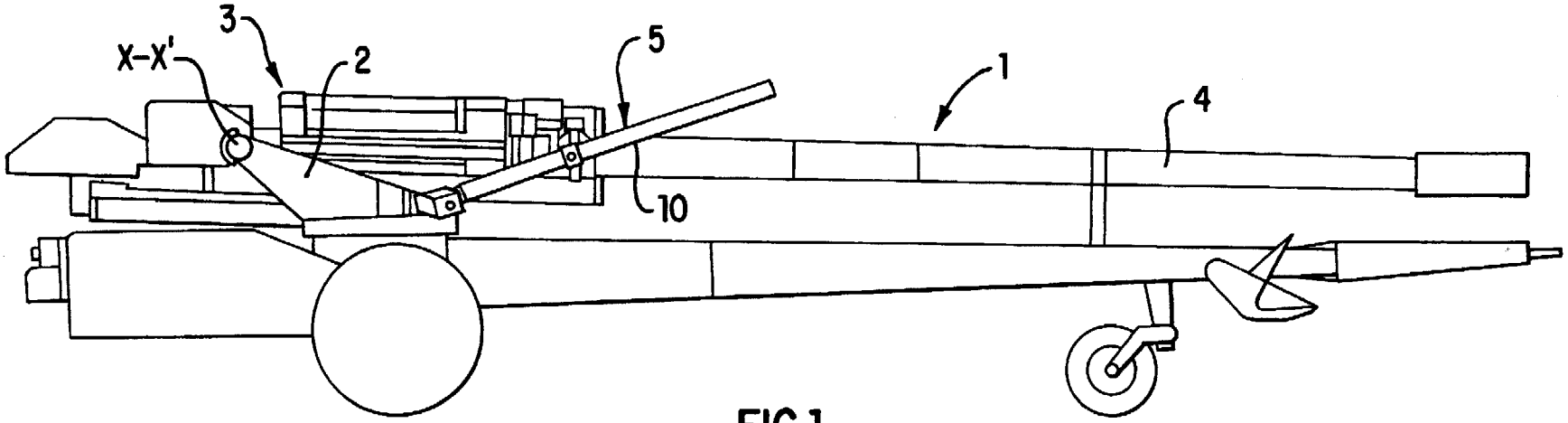
FIG. 1 is a side view of a piece of artillery comprising a control mechanism according to the invention.

With reference to FIG. 1, a piece of artillery 1 includes a top carriage 2 upon which a pivoting mass 3, including an ordnance 4, is fastened in a pivoting manner following an axis X—X'. The pivoting mass 3 must be equilibrated.

Figure 2:
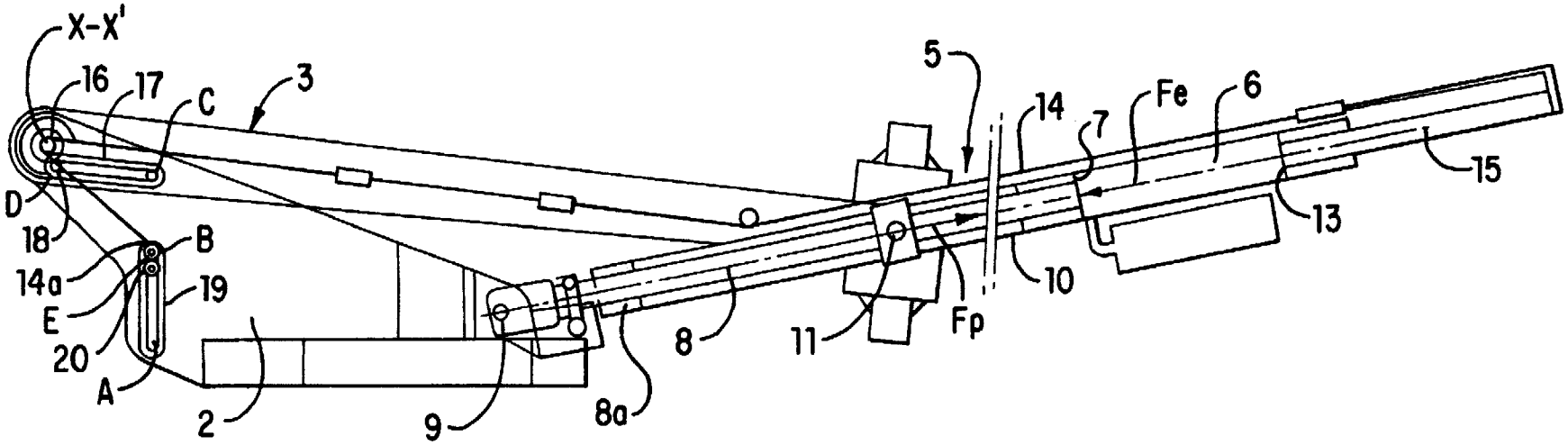
FIG. 2 is a detailed view on a larger scale of the control mechanism.

An equilibrating system is designated by the general reference 5. The system 5 connects the top carriage 2 to the piece of artillery and the mass 3 pivotally mounted on the top carriage. As illustrated in FIG. 2, the system 5 comprises a gas chamber 6 wherein the pressure exerts a force Fe opposed to the force Fp exerted by the pivoting mass 3.

The gas chamber 6 works in conjunction with a piston 7 that is mobile with respect to the gas chamber during the angular displacement of the pivoting mass 3 with respect to the top carriage 2, such that the gas pressure in the chamber 6 varies according to the above angular displacement.

The volume of gas contained in the chamber 6 is calculated so that, at a given temperature, the pressure of the gas exerts a force Fe opposing and roughly equal to the force Fp exerted by the pivoting mass 3.

In addition the system comprises first mechanical means to modify the gas pressure in the chamber 6 for other varying temperatures and second mechanical means to modify the speed of adjustment in the volume of gas during the angular displacement of the pivoting mass.

As shown in FIG. 2, the piston 7 is connected to the top carriage 2 using a screw rod 8 hinged at 9 to the top carriage 2. The piston 7 is slidingly mounted in a cylinder 10 forming the gas chamber 6. The cylinder 10 is connected to the pivoting mass 3 in a hinged manner at 11. The screw rod 8 is mounted in a nut 8*a* integral with the cylinder 10.

The first mechanical means to modify the gas pressure of the chamber 6 comprises a second piston 13 slidingly mounted in the cylinder 10 opposite the first piston 7.

This second piston 13 is connected to means comprising a cable 14 enabling the piston 13 to move with respect to the first piston 7 during the angular displacement of the pivoting mass 3 in order to modify the volume of the gas.

The second mechanical means comprises means enabling the speed of movement of the second piston 13 to be modified during the angular displacement of the pivoting mass in order to modify the speed of adjustment of the volume of the gas.

In the example shown in FIG. 2, the end of the rod 15 of the second piston 13 is connected to a cable 14 such that the movement of the cable imparts a movement in the same direction to the piston 13.

The cable 14 is guided along the cylinder 10 and passes over the pivotal axis X—X' of the pivoting mass 3. The end 14*a* of the cable opposite the second piston 13 is fastened in an adjustable manner to the top carriage 2.

The control means comprises a first recoil-slide 17 integral with the pivoting mass of which one end D is located under the return pulley 16 and of which the other end C is located at a certain distance in front of the first end. The recoil-slide 17 comprises a slide bar 18 which is able to move between the two ends D and C above, from a position wherein the cable 14 passes in front of the slide bar 18, more or less without touching it, to adjustable positions located to the fore of this position wherein the cable is pushed forward by the slide bar 18 such that the cable 14 and the axis of the recoil-slide 17 make a smaller and smaller angle as the slide is pushed forwards.

The mechanism comprises a second recoil-slide 19 integral with the top carriage 2 extending roughly to the height of the latter and comprising a slide bar 20 able to move between a high end E and a low end A of the recoil-slide 19 and to which the end 14*a* of the cable is fastened.

The high end E of the recoil-slide 19 is located under the first recoil-slide 17, roughly to the right of the front end C of the latter.

Figure 3:
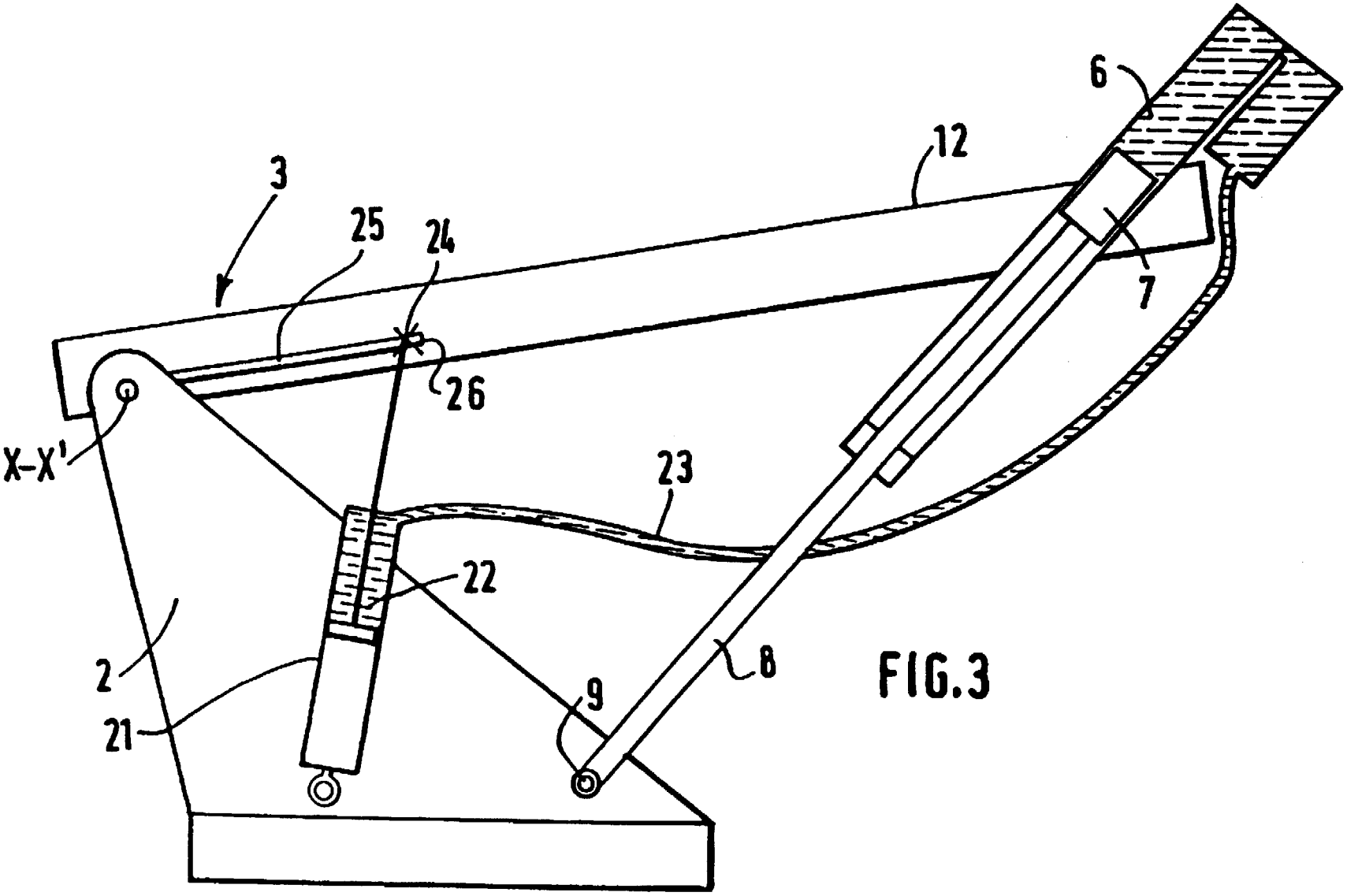
FIG. 3 is a diagram of an alternative embodiment of the control mechanism.

In the alternative embodiment shown in FIG. 3, the first mechanical means to modify the gas pressure in the chamber comprises a gas thruster 21 connected to the top carriage 2 and to the pivoting mass. The gas chamber 22 of the thruster 21 is connected to the gas chamber 6 of the equilibrating system using a flexible connecting tube 23.

The end 24 of the gas thruster 21 connected to the pivoting mass 3 is fastened in a hinged and sliding manner in a recoil-slide 25 extending from a first end near to the pivotal axis X—X' of the pivoting mass 3 to a second end 26 located to forward of the first end.

In the two embodiments described, the volume of gas contained in the chamber 6 is calculated such that at the maximum foreseen temperature (for example 63° C.) for the operation of the piece of artillery, the gas pressure exerts a force Fe which more or less balances the force Fp exerted by the pivoting mass 3 whatever the angle made by the latter.

The means to modify the volume of the gas is adapted so as to enable an adequate reduction in the volume of this gas to roughly obtain the equilibration of the forces Fe and Fp, at the minimum temperature (for example −46° C.) and at the minimum angle of the piece of artillery.

The means to modify the speed of adjustment in the volume of the gas is adequate to obtain the equilibration of the forces, in the above temperature and angle conditions, regardless of the elevation angle of the pivoting mass.

The operation of the mechanism which has just been described will now be explained.

Figure 4:
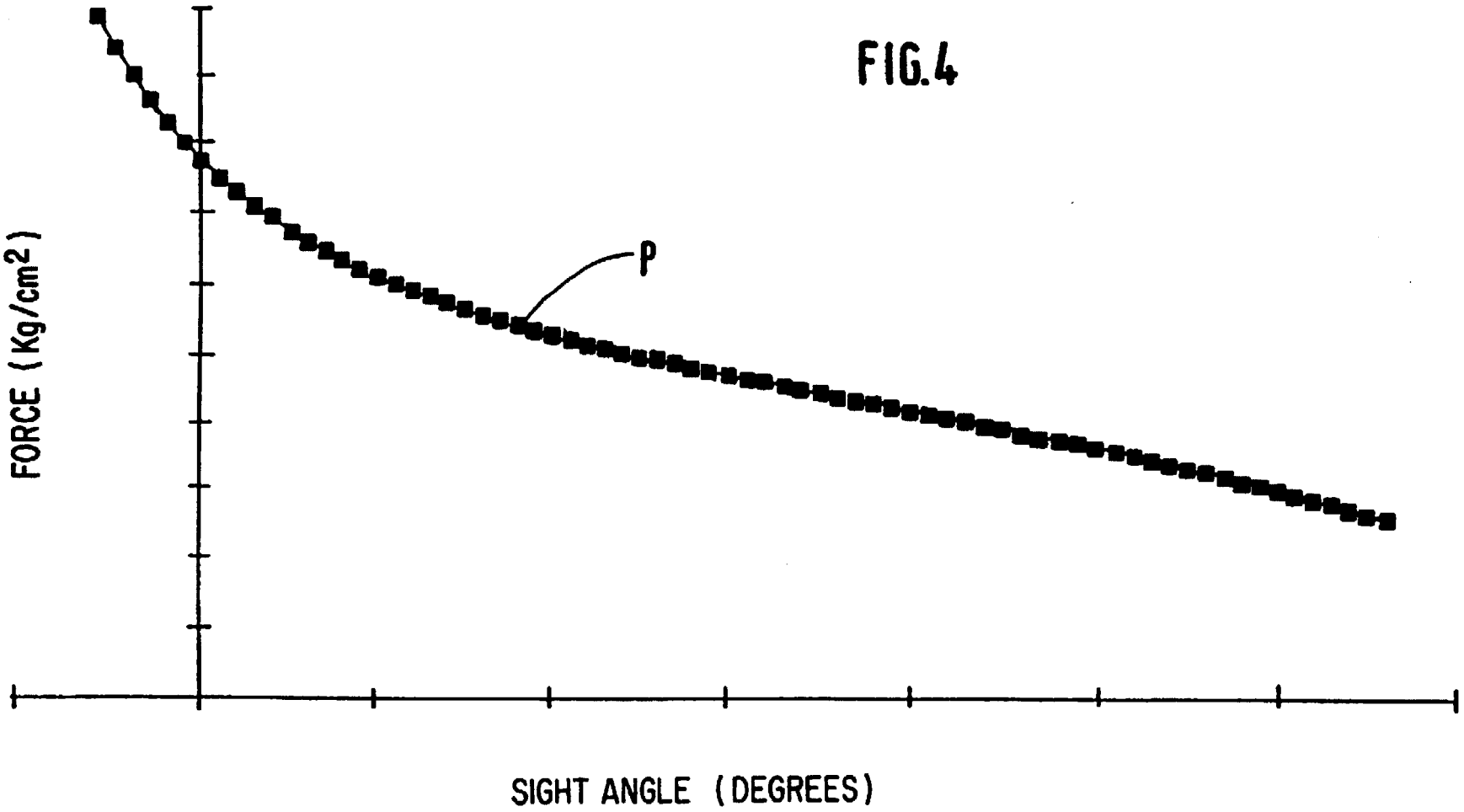
FIG. 4 is a graph showing the adjustment in the force exerted by the pivoting mass of the piece of artillery according to elevation laying angle.

The force Fp generated by the pivoting mass on the equipment on the axis 11 is given by the curve P of the laying force (see FIG. 4). An aim of the invention is to create a force which is as close as possible to this laying force without ever being exactly equal to it (to avoid changes of direction in adjusting) for any angle (in the present example from −6° to +63°) and for temperatures of between −46° C. to +63° C.

Figure 5:
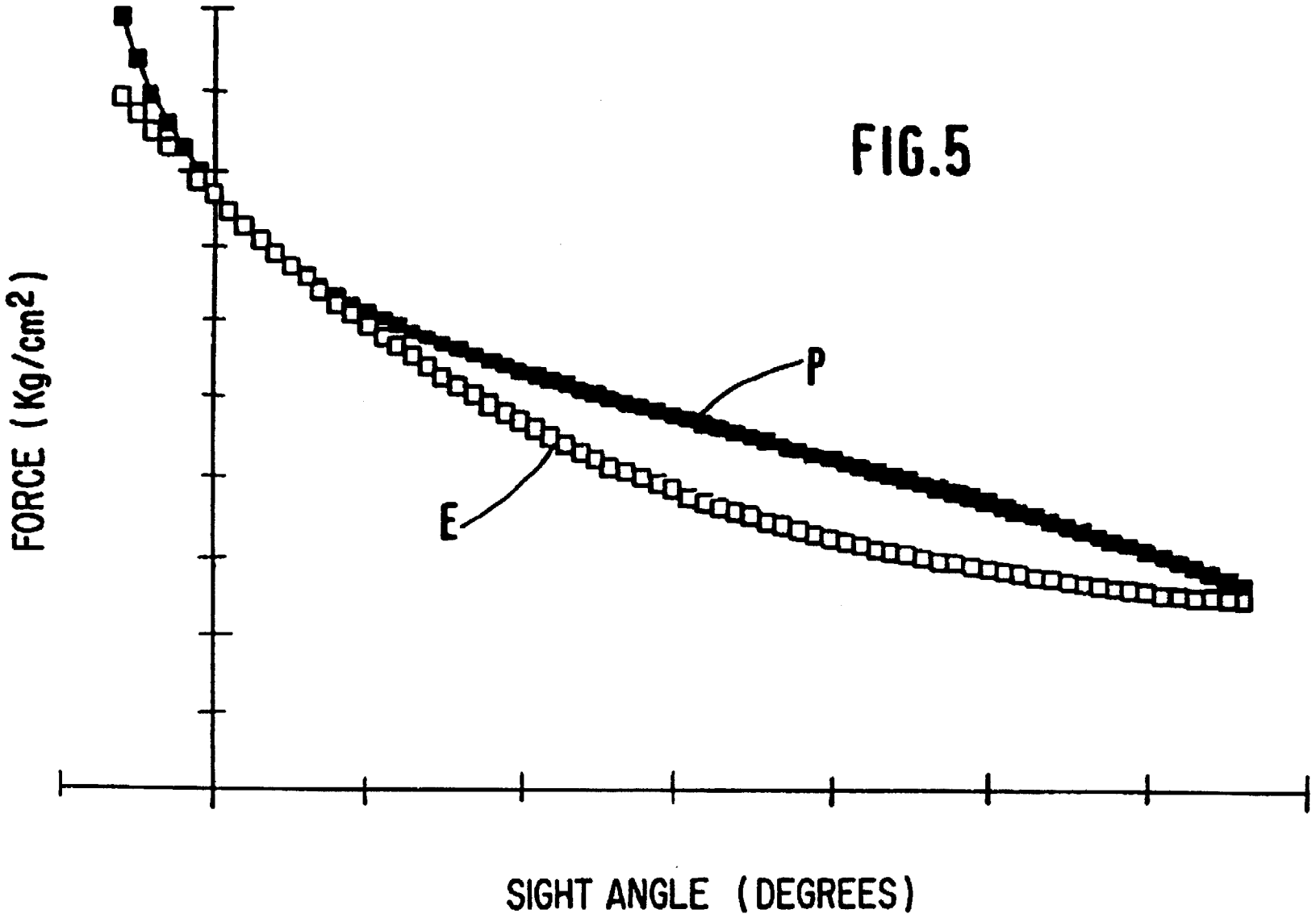
FIG. 5 shows the adjustment curves of the above force and the equilibrating force according to the elevation laying angle at a maximum temperature of 63° C.

Thanks to a certain volume of gas in the chamber 6 and for a given temperature (+63° C.), a satisfactory equilibration is obtained (see FIG. 5) between the laying P and equilibrating E curves.

Figure 7:
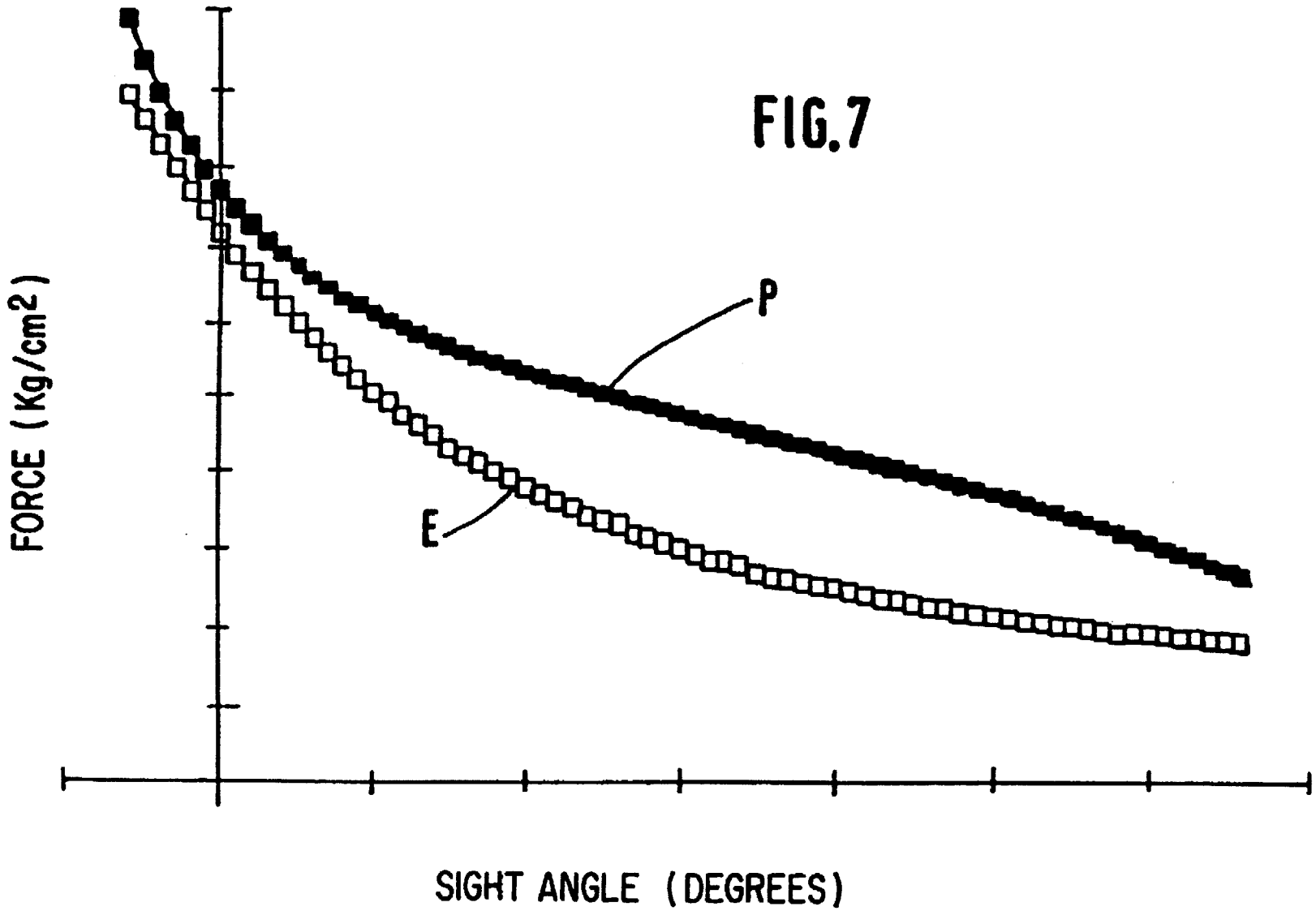
FIG. 7 shows the curves obtained at –46° C. after implementation of the first control device.

When the temperature lowers to −46° C. a large gap between the laying P curve and the equilibrating E curve appears (see FIG. 6) because the fall in temperature leads to a fall in pressure and thus reduces the strength of the equilibrating force. This gap may be removed in the following manner:

First of all, the nitrogen pressure is increased for the initial angular position (i.e. at −6°). This enables the correct equilibrating force to be obtained from the start (see FIG. 7). This is obtained by reducing the volume of nitrogen. But even though the initial pressure is the same (correct force), the initial temperature and volume are different thus the conversion is different and does not produce a high enough pressure for the other elevation laying angles.

Figure 8:
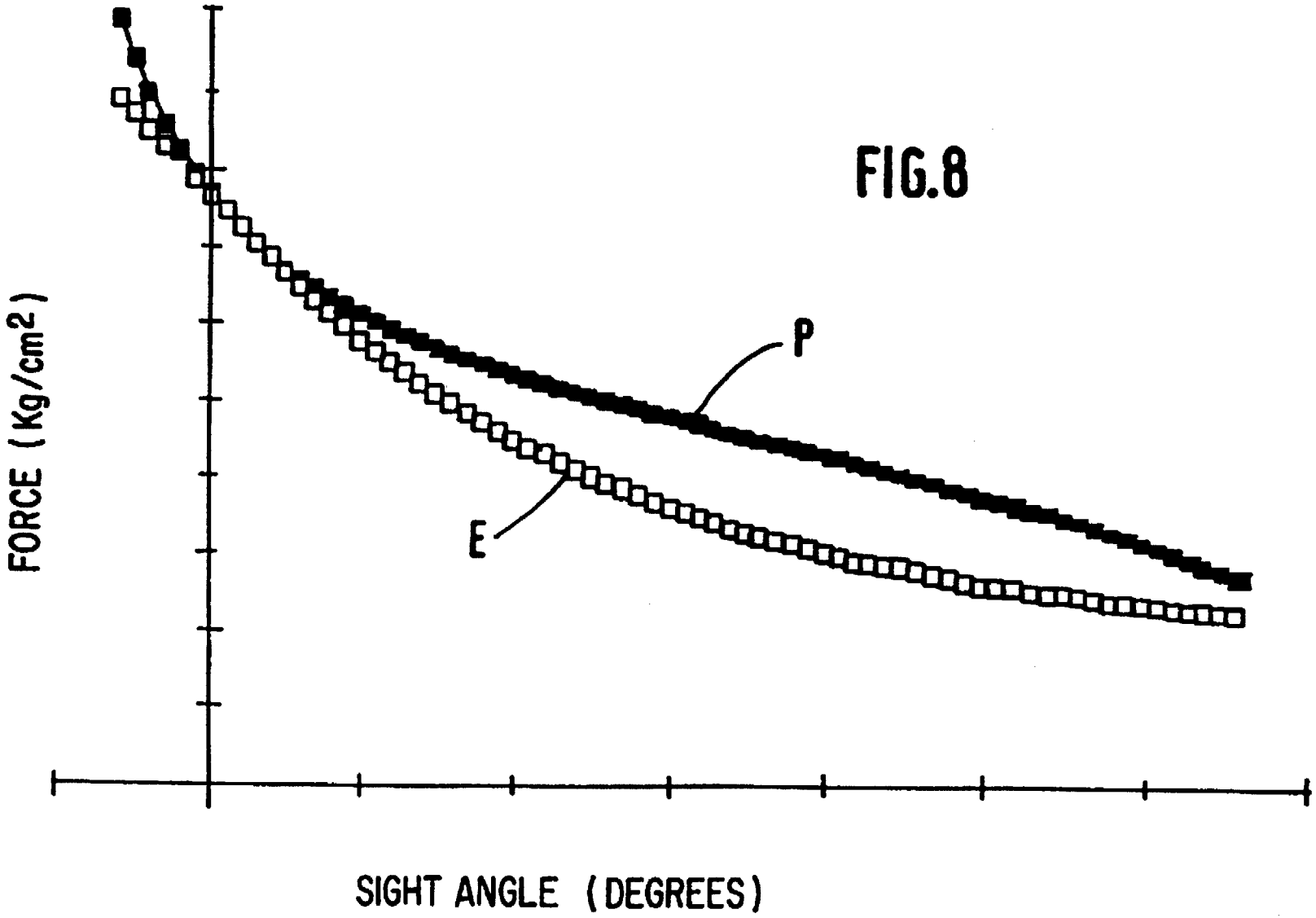
FIG. 8 shows the curves obtained at –46° C. after implementation of the second control device.

The forces must be increased once again in order to better match the curve P of the laying force. The adjustment in volume generated by the laying operation has to be slower than the initial adjustment. In order to do this, two systems must work in conjunction with one another: the piston 7, the movement of which is controlled by the laying system which imposes an adjustment in the volume of nitrogen, and a device which makes the increase in volume more or less rapid. The equilibrating force is thus of the right strength for any angle (see FIG. 8).

The example given herein has been chosen for maximum and minimum temperatures, and for a minimum elevation angle. The volume and the speed of the adjustment in the volume may be adjusted however for any elevation angle.

The operation of the system is described hereafter for laying from a low position to a high position and for a temperature of between +63° C. and −46° C.

The system has two adjustment recoil-slides 17, 19 (see FIG. 2).

At +63° C. the cable 14 is fastened at B and the sliding point is at D.

When the laying angle increases, the cable 14 does not move with respect to the pivoting mass 3 therefore the piston 13 does not move. Only the piston 7 translates. The result obtained is shown on FIG. 5.

Figure 6:
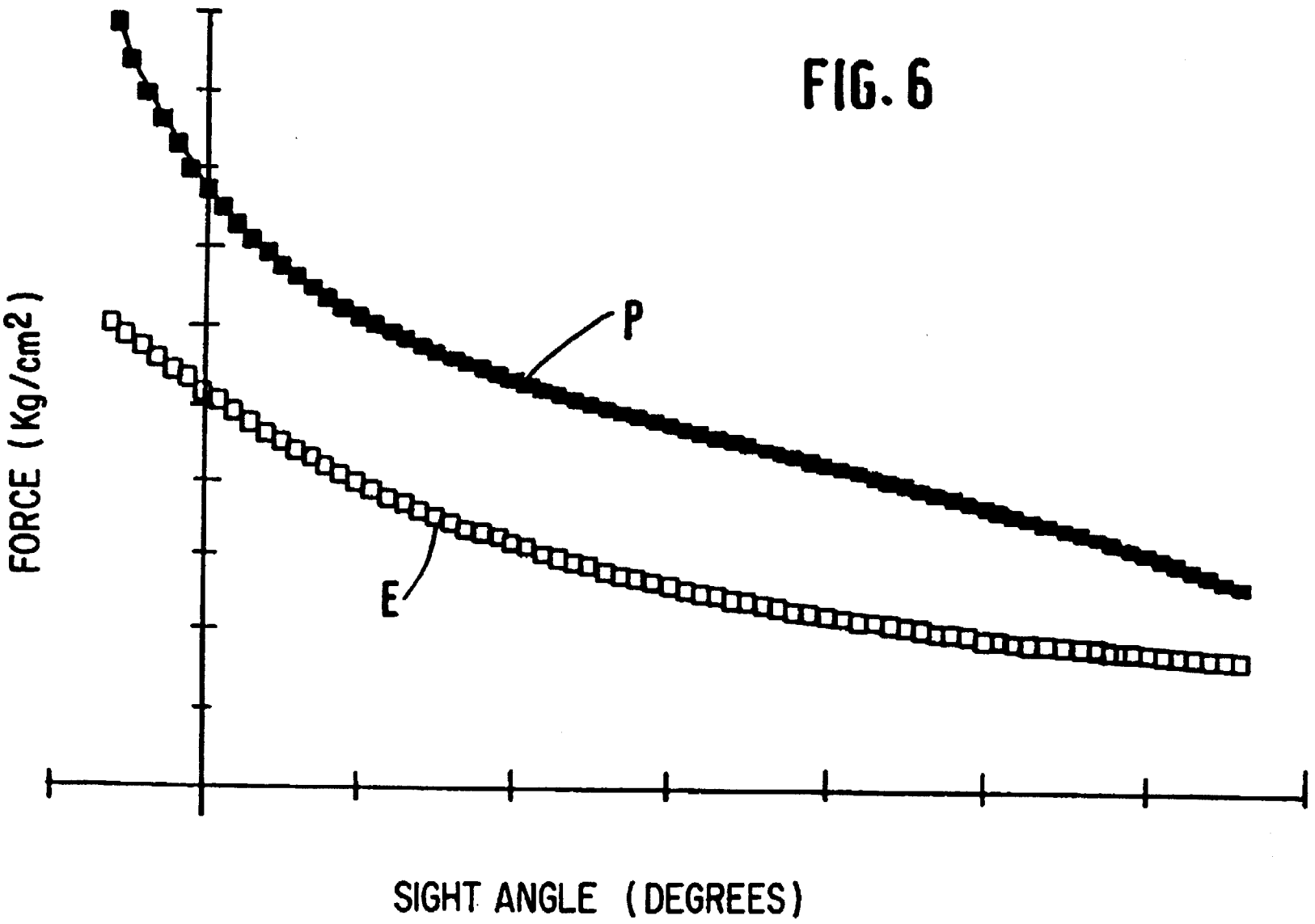
FIG. 6 shows the aforementioned curves obtained at a minimum temperature of –46° C., before implementation the control mechanism according to the invention.

At −46° C., if adjustments have not been made, the laying and equilibrating forces are very different, as shown by the curves in FIG. 6. The initial volume must therefore be reduced to increase the force. The cable is fastened at A (see result in FIG. 7).

For the other elevation laying angles the equilibrating force is too weak. The nitrogen volume must increase more slowly than the rate imposed by the piston 7. The piston 13 must therefore be given a movement which tends to reduce the volume of the chamber 6 when the laying angle increases. To do this the return pulley 18 is adjusted at C (see result FIG. 8).

The operation of the mechanism shown in FIG. 3 enables results to be obtained which are identical to those of the mechanism shown in FIG. 2.

In the example in FIG. 3, the piston 13 has been replaced by the thruster 21 which enables the volume of gas in the chamber 6 and the speed of adjustment of the volume of gas to be modified by adjusting the position of the end 24 of the thruster in the recoil-slide 25.

We claim:

1. A control mechanism for an equilibrating system of a piece of artillery, the equilibrating system connecting a top carriage of the piece of artillery and a pivoting mass pivotably mounted on the top carriage, the equilibrating system further including a gas chamber including a variable volume of gas and a first piston that cooperate to create a gas pressure to provide an opposing force that can counteract a resulting force exerted by the pivoting mass during angular displacement of the pivoting mass with respect to the top carriage, the control mechanism comprising:

first device capable of modifying the gas pressure in the gas chamber to compensate for changes in temperatures in which the equilibrating system operates; and second device capable of modifying an adjustment speed in the volume of the gas in the gas chamber during angular displacement of the pivoting mass.

2. A mechanism according to claim 1, wherein the volume of gas contained in the gas chamber is calculated such that at a maximum operational temperature of the piece of artillery, the opposing force substantially balances the resulting force exerted by the pivoting mass regardless of the angle made by the pivoting mass, and wherein the first device is configured and structured so as to enable an increase in the volume of the gas that substantially balances the opposing and resulting forces at a minimum temperature and at a minimum angle of the piece of artillery, and wherein the second device is structured and configured to substantially obtain equilibration of the opposing and resulting forces within a temperature range spanning the minimum and the maximum temperatures and angle conditions regardless of the angle made by the pivoting mass.

3. A mechanism according to claim 1, wherein the first device comprises a gas thruster connected to both the top carriage and the pivoting mass, the gas thruster including a gas chamber connected to the gas chamber of the equilibrating system with a flexible connecting tube.

4. A mechanism according to claim 3, wherein an end of the gas thruster is connected to the pivoting mass, the end being hingedly and slidingly fastened in a recoil-slide extending from a first end adjacent a pivotal axis of the pivoting mass to a second end located a distance from the first end.

5. A mechanism according to claim 1, wherein the first piston is connected to the top carriage by a screw rod hingedly attached to the top carriage, the first piston being slidingly mounted in a cylinder forming the gas chamber, the cylinder being hingedly connected to the pivoting mass, the screw rod being mounted in a nut integral with the cylinder.

6. A mechanism according to claim 5, wherein the first device comprises a second piston slidingly mounted in the cylinder opposite the first piston, the second piston being movable with respect to the first piston during the angular displacement of the pivoting mass to modify the volume of the gas.

7. A mechanism according to claim 6, wherein the second device comprises a speed regulator capable of modifying a speed of movement of the second piston in order to modify the adjustment speed in the volume of the gas during the angular displacement of the pivoting mass.

8. A mechanism according to claim 6, wherein the second piston is connected to a cable that cooperates with a return pulley mounted on a pivot axis of the pivoting mass, and wherein an end of the cable opposite the second piston is adjustably fastened to the top carriage.

9. A mechanism according to claim 8, further comprising a first recoil-slide integral with the pivoting mass, wherein a first end of the first recoil-slide is located below the return pulley and a second end is located at a certain distance from the first end, the recoil-slide having a slide bar moveable between the first and second ends from a first position wherein the cable can pass in front of the slide bar, without touching the slide bar, to adjustable positions located toward the second end of the first recoil-slide, wherein the cable can be pushed forwards by the slide bar such that an angle between the cable and an axis of the recoil-slide decreases as the slide is pushed forwards.

10. A mechanism according to claim 9, further comprising a second recoil-slide integral with the top carriage and extending substantially to a height of the top carriage, said second recoil-slide comprising a second slide bar moveable between a high end and a low end of the second recoil-slide, wherein the end of the cable is fastened to the second slide bar.

11. A mechanism according to claim 10, wherein the high end of the second recoil-slide is located substantially below the second end of the first recoil-slide.

12. A method for controlling an equilibrating system of a piece of artillery, the equilibrating system connecting a top carriage of the piece of artillery and a pivoting mass pivotably mounted on the top carriage, the equilibrating system further including a gas chamber including a variable volume of gas and a first piston that cooperate to create a gas pressure to provide an opposing force that can counteract a resulting force exerted by the pivoting mass during angular displacement of the pivoting mass with respect to the top carriage, and a second piston connected to a cable that cooperates with a return pulley mounted on a pivot axis of the pivoting mass, the method comprising:

modifying the gas pressure in the gas chamber to compensate for changes in temperatures in which the equilibrating system operates; and modifying an adjustment speed in the volume of the gas in the gas chamber during angular displacement of the pivoting mass.

13. A method according to claim 12, wherein the equilibrating system further comprises a first recoil-slide integral with the pivoting mass, wherein a first end of the first recoil-slide is located below the return pulley and a second end is located at a certain distance from the first end, the recoil-slide having a slide bar moveable between the first and second ends from a first position wherein the cable can pass in front of the slide bar without touching the slide bar, to adjustable positions located toward second end of the recoil-slide, wherein the method further comprises pushing the cable forwards with the slide bar such that an angle between the cable and an axis of the recoil-slide decreases as the slide is pushed forwards to change the volume adjustment speed.

14. A method for balancing an equilibrating system of a piece of artillery operable in a variety of temperatures and laying angles, the equilibrating system including a pivoting mass and a first piston including a gas chamber including a variable volume of gas, said gas chamber being pressurizable to provide an opposing force that can counteract a resulting force exerted by the pivoting mass during angular displacement of the pivoting mass, the method comprising:

modifying the gas pressure in the gas chamber to compensate for changes in temperatures in which the equilibrating system operates; and modifying an adjustment speed in the volume of the gas in the gas chamber during angular displacement of the pivoting mass.

15. An apparatus for balancing an equilibrating system of a piece of artillery operable in a variety of temperatures and laying angles, the equilibrating system including a pivoting mass and a first piston including a gas chamber including a variable volume of gas, said gas chamber being pressurizable to provide an opposing force that can counteract a resulting force exerted by the pivoting mass during angular displacement of the pivoting mass, the apparatus comprising:

a first device capable of modifying the gas pressure in the gas chamber to compensate for changes in temperatures in which the equilibrating system operates; and a second device capable of modifying an adjustment speed in the volume of the gas in the gas chamber during angular displacement of the pivoting mass.

16. An equilibrating system for a piece of artillery operable in a variety of temperatures and laying angles, the equilibrating system comprising:

a pivoting mass;

a first piston including a gas chamber having a variable volume of gas, said gas chamber being pressurizable to provide an opposing force that can counteract a resulting force exerted by the pivoting mass during angular displacement of the pivoting mass;

first means for modifying the gas pressure in the gas chamber to compensate for changes in temperatures in which the equilibrating system operates; and second means for modifying an adjustment speed in the volume of the gas in the gas chamber during angular displacement of the pivoting mass.

* * * * *